US005156139A

United States Patent [19]

Wilson, Jr.

[11] Patent Number: 5,156,139

[45] Date of Patent: Oct. 20, 1992

[54] CONTROLLED LABYRINTH HEAT EXCHANGING OIL NOZZLE ASSEMBLY

[76] Inventor: James C. Wilson, Jr., 28251 Georgetown Rd., Salem, Ohio 44460

[21] Appl. No.: 588,053

[22] Filed: Sep. 25, 1990

Related U.S. Application Data

[63] Continuation-in-part of Ser. No. 523,064, May 14, 1990, Pat. No. 5,022,379.

[51] Int. Cl.[5] ..... F24H 3/00

[52] U.S. Cl. ..... 126/116 R; 431/36; 431/208; 126/99 R

[58] Field of Search ..... 126/116 R, 99 R; 431/11, 36, 161, 207, 208, 210, 211; 219/205, 305, 275; 239/133, 135

[56] References Cited

U.S. PATENT DOCUMENTS

| | | | |
|---|---|---|---|
| 588,449 | 8/1897 | Kretschmann | 431/211 |
| 2,195,170 | 3/1940 | Henson | 431/207 |
| 4,047,880 | 9/1977 | Calderlli | 431/208 |
| 4,609,811 | 9/1986 | Danner | 431/208 X |
| 4,723,065 | 2/1988 | Meyer | 431/208 X |

*Primary Examiner*—Larry Jones
*Attorney, Agent, or Firm*—George W. Dishong

[57] ABSTRACT

Basically the present invention in it's most simple form or embodiment is directed to a controlled labyrinth heat exchanging oil nozzle assembly for use as a flame producing nozzle within an oil burning heating system, particularly adapted to burning of waste oil. The nozzle assembly comprises a block, the temperature of which is controlled or controllable and in which there is at least one cylindrical bore (preferably two bores are provided) into which director plugs are specially inserted. The block, the bore or bores and the flow director plug or plugs are designed to provide a fuel flow passage which undulates upward and downward thereby increases the dwell time or the time during which fuel is within the block and also creating substantial surface area through which heat is transferred or transferable from the block when it is heated to the fuel flowing in such an undulating manner therethrough. There is also provided an air passage within the block and which provides air at appropriate pressure to an air atomizing flame producing nozzle. The air is also heated by the block so that the air is at an appropriate and desirable temperature when it mixes with the fuel at the nozzle. All of these features are achieved along with providing for total and easy access to virtually all of the primary heat exchange surfaces and the surfaces of the fuel passage for the purpose of inspection and thorough cleaning without the necessity of taking the assembly "off line".

4 Claims, 3 Drawing Sheets

CONTROLLED LABYRINTH HEAT EXCHANGING OIL NOZZLE ASSEMBLY

This application is a continuation-in-part of U.S. patent application Ser. No. 523,064, filed on May 14, 1990 now U.S. Pat. No. 5,022,379, Jun. 11, 1991, the disclosure of which is hereby incorporated by reference.

BACKGROUND OF THE INVENTION

1. Field of the Invention

This invention most generally relates to a controlled labyrinth heat exchanging oil nozzle assembly which may be used in conjunction with a heat exchanging device for heating a fluid such as air. The heat exchanging device provides heated air by conduction of heat, at a plurality of locations, from a combustion gas space to the fluid. Such heat exchanging device as is disclosed in the application incorporated herein by reference thereto. Even more particularly the invention relates to a controlled labyrinth heat exchanging oil nozzle assembly which is use along with a flame producing nozzle within an oil burning heating system wherein the nozzle assembly comprises a block, the temperature of which is controlled or controllable and in which there is at least one cylindrical bore (preferably two bores are provided) into which director plugs are specially inserted. The block, the bore or bores and the flow director plug or plugs are designed to provide a fuel flow passage which undulates upward and downward thereby increases the dwell time or the time during which fuel is within the block and also creating substantial surface area through which heat is transferred or transferable from the block when it is heated to the fuel flowing in such an undulating manner therethrough. There is also provided an air passage within the block and which provides air at appropriate pressure to an air atomizing flame producing nozzle. The air is also heated by the block so that the air is at an appropriate and desirable temperature when it mixes with the fuel at the nozzle. All of these features are achieved along with providing for total and easy access to virtually all of the primary heat exchange surfaces and the surfaces of the fuel passage for the purpose of inspection and thorough cleaning without the necessity of taking the assembly "off line". It is also very easy to remove oil and residue of the fuel/oil from the passage by removing the nozzle and appropriately plugging the nozzle end of the block then providing air or gas pressure through the air passage which is diverted from the nozzle end back through the undulating fuel passage toward the block fuel input end where, with the fuel supply line removed, the waste oil and the residue that was residing in the passage may be collected and discarded. This operation can be achieved without removal of the director plugs. All such elements and the respective geometries, provide for controlled residence time for the fuel within the heated block thereby uniformly transferring or exchanging heat from the block to the fuel flowing therethrough to a commercial type atomizing nozzle.

2. Description of the Prior Art

In order to be able to burn waste oil products in an efficient and ecologically sound manner, it is critical that the combustion efficiency be within well defined specifications. It is required that the efficiency be not less than 75% as measured according to industry accepted standards of testing and that the residuals emitted be as completely oxidized as possible at this efficiency level. The maintenance must be low, the combustion efficiency high, and there must be high thermal energy transfer in order that the system be acceptable for such use. In particular, the design of a device for the burning (rapid oxidation) of contaminated waste oils should have a smooth uniform, constant, controlled flow of combustion gases throughout and there should be no abrupt direction changes of the gases while they are at the highest temperature, i.e., prior to the combustion gases giving up most of the heat to the fluid. This is necessary to uniformly deposit, within the device those noncombustibles inherently generated by this process. When this is accomplished the heat exchange degradation process is more nearly uniform preventing premature heat exchange loss in any given area.

It would be desirable and advantageous to have a heat exchange device which would be capable of burning waste oil products efficiently and in a manner which would allow easy cleaning of the burner unit and the heat exchanger and the fuel oil nozzle assembly. It would also be desirable to have a nozzle assembly which could be used in the burning of waste oil as a fuel which oil has substantial residues. Such an assembly must be able to elevate the temperature of the fuel oil and the air which will be mixed with the fuel at the atomizing nozzle and at the same time have a reasonable volumetric size. In addition it is important that a nozzle assembly be provided which does not trap residue from the waste oil, which is easily and efficiently cleaned and in which the temperature of the oil/fuel/waste oil can be elevated and controlled prior to it being mixed and atomized at the tip of the nozzle. Further, there should be provided means for preventing or controlling the "dripping" at the nozzle tip at shutdown. Such control is very important so that residue buildup in the furnace, below the nozzle input region, is kept to a minimum. None of the prior art devices have been able to combine in reasonable and acceptable ways the features which will increase the fuel dwell time by increasing the effective length of the passage from the fuel line through the heating device and then to the nozzle in order to raise the temperature of the fuel to the desired level, along with providing for ease of inspection and cleaning of the fuel passage through the heating device or the block.

It is also very important that the device can be quickly, easily and thoroughly cleanable. In the burning of waste oil those noncombustibles contained in the waste oil deposit in the combustion chamber. Additionally, the temperature of the fuel oil being provided at the atomizing nozzle must be controlled at an elevated temperature. To heat the fuel it must be resident within a heating block sufficiently long to allow the fuel to reach the desired temperature. This "dwell time" can be achieved using helical travel or other ways to increase the distance from the fuel input to the heating block to the nozzle end of the block. However, voids are frequently created which create dripping at the nozzle end when the burner shuts down. Additionally, the residiue or the residuals present in waste oil will tend to collect or settle into low regions of the oil passage. This residue will build up rapidly and the assembly must be accessible for inspection and for cleaning. Present nozzle assemblies do not provide the combination of easy access for inspection and cleaning along with sufficiently long dwell time. It is simply not possible or it is at best very inconvenient and difficult to inspect and thoroughly-clean such assemblies. In order to maintain the needed and desirable high efficiency of a system, the deposits within the nozzle assembly must be easily and frequently removed or removed when an inspection shows an unacceptable level of residue.

The instant invention especially when it is used in conjunction with the heat exchanger disclosed in Applicant's U.S. Pat. No. 4,905,661 and with the heat exchanger disclosed and claimed in the referenced U.S. Patent Application, accomplishes such objectives. In accomplishing the objectives of efficient burning of waste oil, the device is also very effective and efficient and very maintenance free when burning conventional heating oil. Applicant is not aware of any heat exchanger devices or assemblies presently available which meet the necessary criteria for the proper and effective burning of waste oil products coupled with the ability to expose completely and in total all surfaces for necessary, periodical inspection and/or mechanical cleaning. Nor is Applicant aware of a device which incorporates all of these desirable features within the relatively small volumetric configuration possible with this invention. In fact Applicant is unaware of any such units available which have the advantages and characteristics described that burn regular fuels such as heating oil and/or gas.

Some inventions related to the instant invention and disclosed in the following United States Patents have been studied. The following is a brief description and discussion of these related inventions.

Wilson, U.S. Pat. No. 4,905,661, a heat exchanger with which the present invention may be advantageously used, discloses cylindrical heat exchanger in which the flame is introduced into the device about perpendicular to the axis of the flow of both the combustion gases and the air which is being heated in the device. In the patented device, the combustion gases flow in a helical path around the inner shell through which air to be heated flows in an axial path through the device and the flame is introduced into the combustion chamber in a direction perpendicular to the axis of the heat exchanger.

Niederholtmeyer, U.S. Pat. Nos. 4,392,820 and 4,460,328 describe very complicated systems and methods for use in burning conventional heating oil and waste oil in combination. There are two distribution networks which communicate with a heating box. Neither of these patents disclose a structure which has the features and the advantages of the structure disclosed in the instant application.

SUMMARY OF THE INVENTION

Basically the present invention in it's most simple form or embodiment is directed to a controlled labyrinth heat exchanging oil nozzle assembly which may be used in conjunction with a heat exchanging device for heating a fluid such as air.

It is a primary object of the present invention to provide a controlled labyrinth heat exchanging oil nozzle assembly for use as a flame producing nozzle within an oil burning heating system, particularly adapted to burning of waste oil. The assembly comprises a temperature controllable block portion having a fuel input end and an atomizing nozzle end; a means for attaching an atomizing nozzle at the atomizing nozzle end; a means for undulatingly directing, in an upward and a downward manner, fuel from the fuel input end to the atomizing nozzle end and in fuel communication with an attached atomizing nozzle; a means for restricting and controlling flow rates of fuel passing through the means for directing; a means for sensing and means for controlling temperature of the block and consequently the fuel flowing through the block; and means for directing atomizing air through the block portion and in air communication with the attached atomizing nozzle.

It is another primary object of the present invention to provide the controlled labyrinth heat exchanging oil nozzle assembly with flow director plugs which in combination with cylindrical bores in the block define the means for undulatingly directing the fuel from the block fuel input end to the nozzle end and further providing means for quickly removing and for sealingly inserting and positioning the plugs into the bores of the block to create the fuel passage. When the plugs are removed total and easy access is available to virtually all of the primary heat exchange surfaces and the surfaces of the fuel passage for the purpose of inspection and thorough cleaning without the necessity of removing the assembly from the heating system.

Yet another primary object of the present invention to provide a nozzle assembly in which the period of time in which the fuel is within the heated block can be controlled by the geometries of the components so that proper temperatures of both the fuel and the air can be achieved prior to mixing at the atomizing nozzle.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

For the sake of brevity, clarity, and simplicity I shall not describe in detail those familiar parts which have long been constituents of furnaces, such as; hot air systems, fans or air blower assemblies, burner units and their associated components such as pilots, or electrodes and atomizing nozzles (except to the extent of the incorporation of the nozzle into the assembly), control systems for controlling temperatures of stacks or of the region being heated or of the medium or fluid being heated etc. These constituents or elements of systems in which the controlled labyrinth heat exchanger oil nozzle assembly of the instant invention may be used, are well known to those of ordinary skill in the heat exchanger/heater/furnace art. It is also understood that components or constituents such as air filters, fuel oil filters, fuel lines, power supplies and the like will be assumed to be incorporated within the system as is deemed to be appropriate for those systems using the controlled labyrinth heat exchanging oil nozzle assembly of the present invention. Further, for the sake of explanation the fluid described as being heated will be in most instances air. Also, because the device may be scaled to provide for small or large systems capable of generating various levels of thermal energy, the dimensions of the controlled labyrinth heat exchanging oil nozzle assembly/device is not fixed. However, the members have dimensions all of which are related one to the other so that upon assembly of the members to obtain the device, properly sized spaces and volumes and apertures and flow paths are defined.

Figure 1:
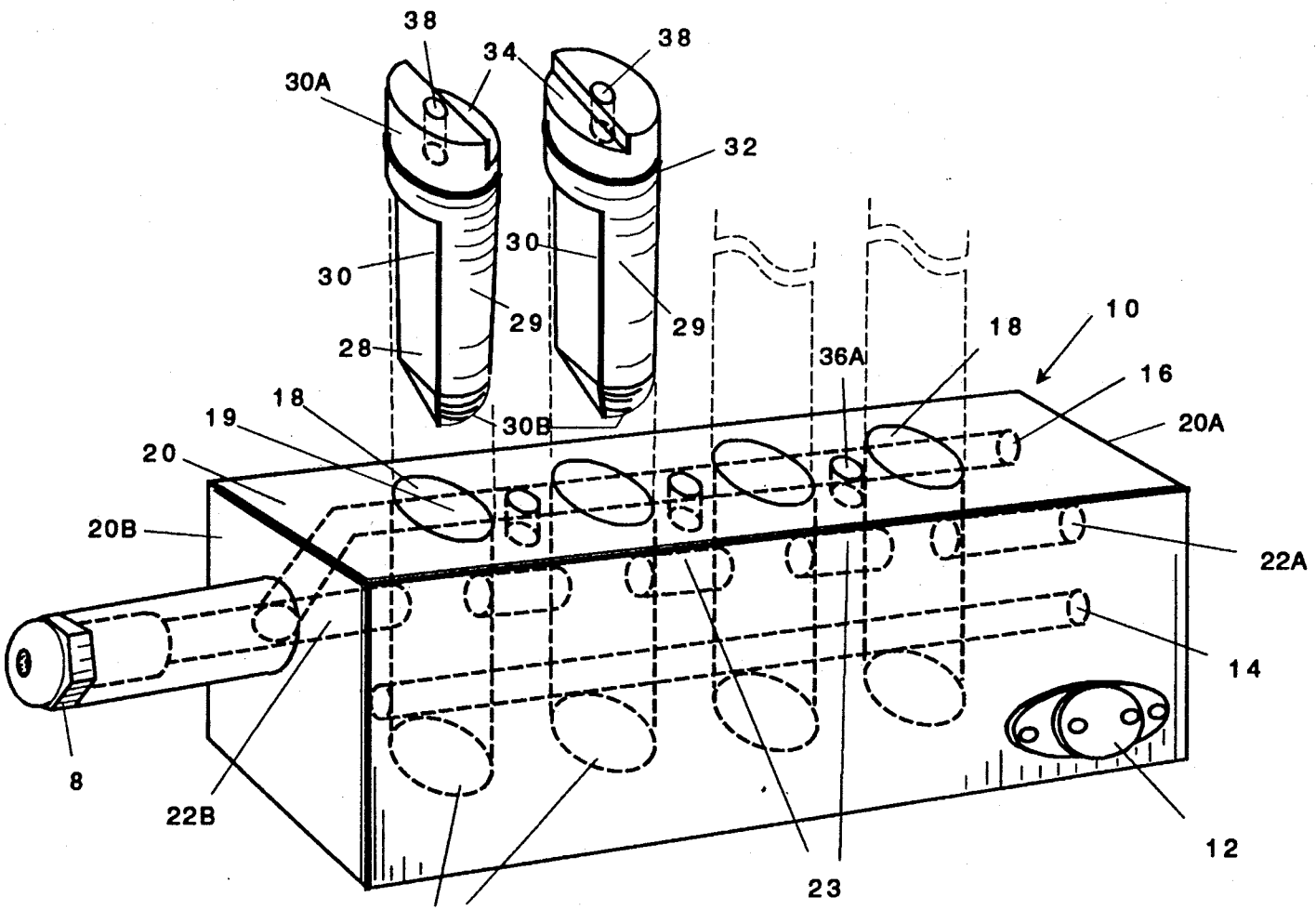
FIG. 1 is a perspective view of the controlled labyrinth heat exchanging oil nozzle assembly having cutaway sections to illustrate the respective locations of some of the various elements and spaces of the instant invention.
Figure 2:
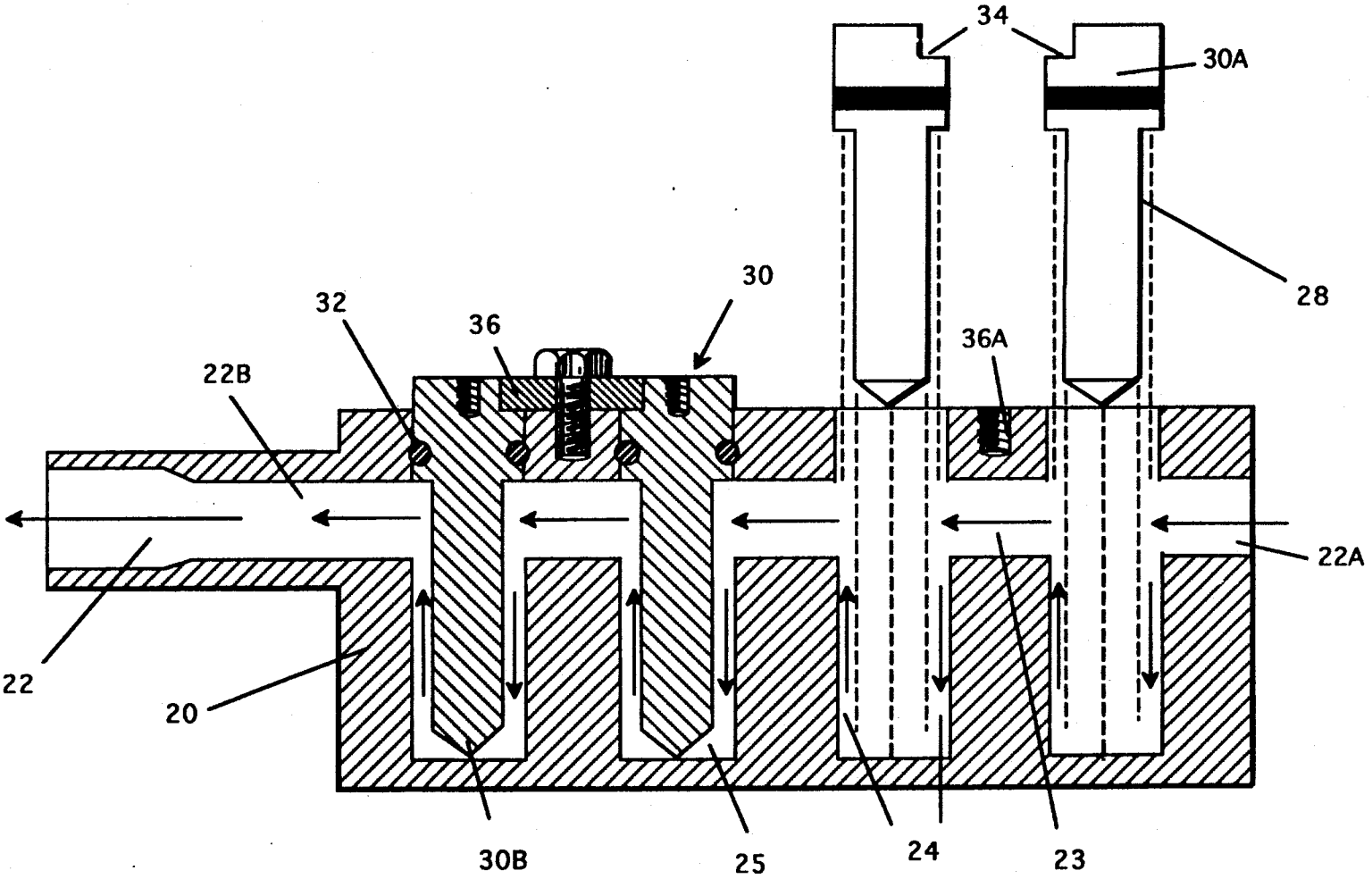
FIG. 2. is a cross-sectional view illustrating the fuel flow from the input end to the nozzle end of the assembly and illustrating one means for securing and locating the director plugs.
Figure 3:
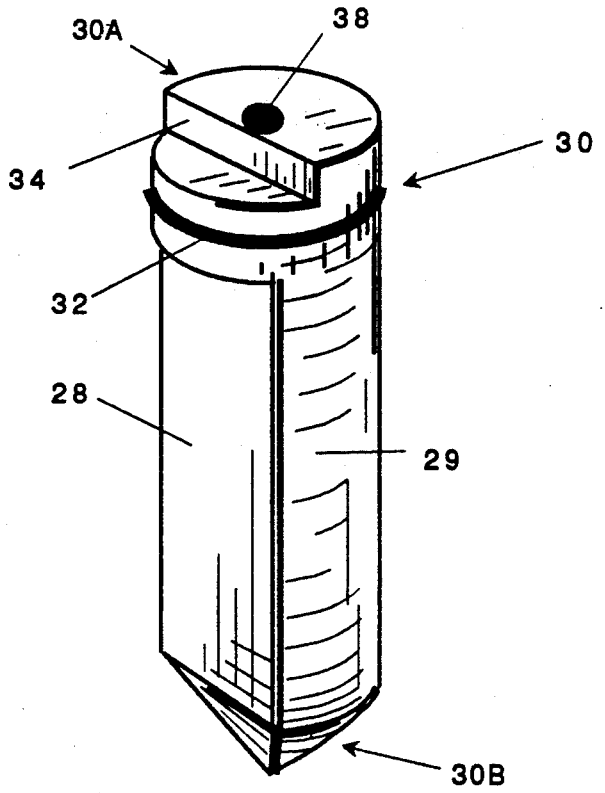
FIG. 3 is a perspective view of the flow directing plug showing the input/output flat portions, the cylindrical portion, the tip end and the seal end with an "o-ring" seal.
Figure 4:
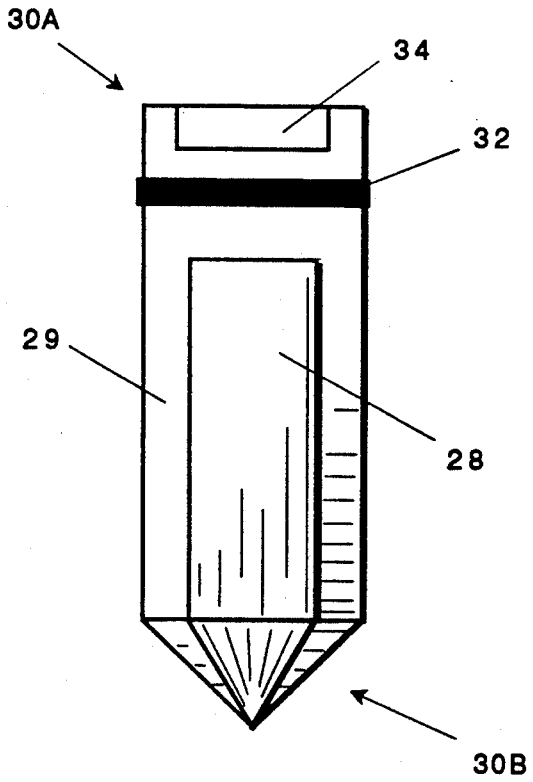
FIG. 4 is a view of the flat side of the fluid flow directing plug.

The construction of the controlled labyrinth heat exchanging oil nozzle assembly 10 will be described with reference to FIGS. 1–4 collectively. The assembly 10 is substantially comprised of two (2) fundamental components or members; a block portion 20, and at least one flow director plug 30 which sealingly fits into a corresponding at least one slip-fitting cylindrical bore 18. In the preferred embodiment there is at least two (2) cylindrical bores 18 and a like number of flow directing plugs 30. These members 20 and 30 are sized relative to each other and assembled in space relationship so as to define an undulating fuel flow directing passage 22 which passage 22 has an input segment or end 22A, horizontal segments 23, vertical segments 24 created by the combined geometries of plugs 30 and the bores 18 and in particular the cylinder bore walls 19 and the director plugs input/output flat portions 28, bottom segments 25 which are created by the combined geometries of the cylinder bore bottom 17 and the flow director tip end or bottom end 30B and finally an output segment 22B in fuel flow communication with an air atomizing nozzle 8 which is of the commercially available types. Included in assembly 10 is an air or other gas passage 16 which passes through block 20 preferably disposed horizontally from the fuel passage input segment 22A and the horizontal segments 23 and adapted to be attachable to conventional fittings for providing typically air under a controlled or controllable pressure at the end of the block 20 opposite nozzle 8. The air passage 16 is adapted to be in air communication with the nozzle 8 when nozzle 8 is attached or affixed to assembly 10.

Included within block 20 is a means 14 for locating and securing the heating elements within block 20. Temperature sensing means 12 is provided for sensing the temperature of either the block 20 or the fuel flowing through passage 22 and for ultimately controlling the temperature of the block 20 or the fuel by providing thermal energy via the heating elements or providing signals which turn thermal energy on or off to the assembly 10.

The flow director plugs 30 have a seal end or top end 30A and a tip end or bottom end 30B. The end 30A is configured to include a groove for an "o" ring which comprises sealing means 32 and which is dimensioned to sealingly fit into cylinder bores 18. There is also preferably provided a threaded hole located on the upper surface of the end 30A into which a bolt or special tool may be inserted so that plug 30 may be remove from bore 18 when plug securing and locating device 36 is removed from threaded hole 36A located in block 20 between bores 18. The director plugs 30 have incorporated thereon input/output flat portions 28 which are oppositely disposed and two (2) cylindrical sections 29 also oppositely disposed. The cylindrical sections 29 fit snugly within cylindrical bores 18 so that the vertical segments 24 of passage 22 are substantially defined by the input/output portions 28 and the bore walls 19. The tip end 30B in combination with the bottom surface 17 of bore 18 define the bottom segments 25 of passage 22. For the purpose of inspection and cleaning of the assembly 10 and particularly of passage 22, it is necessary to simply remove the plugs 30 by removing plug positioning device 36 which in the preferred embodiment, cooperates with notches 34 on the seal end 30A of plugs 30 and which notches 34 also control the depth of plugs 30 into cylinder bores 18. The plugs 30 may then be extracted using a tool specially designed to fit into holes 38 or a bolt having the proper thread size given that holes 38 are threaded. The removal of the plugs 30 allows for the inspection and cleaning of virtually every surface which defines passage 22. The combination of elements which define assembly 10 and the respective geometries can be used to control the fuel flow rate so that there are no voids or stagnation regions within passage 22. In other words, when fuel flows it flows across the entire cross section of all of the various segments 23, 24, 25, and the input and output segments 22A and 22B of fuel passage 22. This feature is important especially for low pressure-heavy oil/waste oil burner systems.

The block 20, the bore or bones 18 and the flow director plug or plugs 30 are designed to provide a fuel flow passage 22 which undulates upward and downward thereby increases the dwell time or the time during which fuel is within the block 20 and also creating substantial surface area through which heat is transferred or transferable from the block 20 when it is heated to the fuel flowing in such an undulating manner therethrough. The air passage 16 provided within the block 20 provides air at appropriate pressure to the air atomizing flame producing nozzle 8. The fuel and the air are heated by the heaters positioned in the means 14 provided for locating and securing the heating elements so that the air and the fuel are at an appropriate and desirable temperature when they mix at the nozzle 8. All of these features are achieved along with providing for total and easy access to virtually all of the primary heat exchange surfaces, i.e., the surfaces defining the air passage 16 and the surfaces of the fuel passage 22 for the purpose of inspection and thorough cleaning without the necessity of taking the assembly 10 "off line". It is also very easy to remove oil and residue of the fuel/oil from the passage 22 by removing the nozzle 8 and appropriately plugging the nozzle end 20B of the block 20 then providing air or gas pressure through the air passage 16 which is diverted from the nozzle end 20B back through the undulating fuel passage 22 toward the block fuel input end 20A where, with the fuel supply line removed, the waste oil and the residue that was residing in the passage 22 may be collected and discarded. This operation can be achieved without removal of the director plugs 30.

The controlled labyrinth heat exchanging oil nozzle assembly 10 of the present invention may be secured within a tank, such as a hot water tank. The tank could be designed so that there was sealing around the exhaust tube, the burner flame portal and any other elements which must be kept separated from the water volume. Naturally, there would also be provided a cold water-in fitting and a hot water-out fitting mounted on the tank. Provision would be made for controlling the temperature of the water. The controlled labyrinth heat exchanging oil nozzle assembly 10 could be mounted in a vertical or a horizontal attitude within the tank. Water need only be made to flow over or surround the surfaces which define all of the heat exchange volumes of the heat exchanger or of the means used to transfer heat from hot exhaust gases to the water to be heated.

Ordinary and conventional burner assemblies, control systems, heated air directing assemblies, such as air ducts, air blowers and the like, may be used with the controlled labyrinth heat exchanging oil nozzle assembly 10 incorporated therein.

It is understood that the device as illustrated and described herein may have different dimensions and variations of the illustrated basic geometry and may have different attitudes within the system wherein the instant device 10 is being used. It is also understood that the device can be scaled up or down to provide for more or less BTU's of heat respectively. It is also thought that the controlled labyrinth heat exchanging oil nozzle assembly 10 of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A controlled labyrinth heat exchanging oil nozzle assembly for use as a flame producing nozzle within an oil burning heating system, said assembly comprising:

a temperature controllable block portion having a liquid fuel input end and an atomizing nozzle end;

means for attaching an atomizing nozzle at said atomizing nozzle end;

means for undulatingly directing, in an upward and a downward manner, liquid fuel from said liquid fuel input end to said atomizing nozzle end and in fuel communication with an attached atomizing nozzle;

means for restricting and controlling flow rates of liquid fuel passing through said means for undulatingly directing;

means for sensing and means for controlling temperature of said block and consequently said liquid fuel flowing from said fuel input end to said atomizing nozzle end; and means for directing atomizing air from an air source through said block portion and in air communication with said atomizing nozzle when said atomizing nozzle is attached.

2. The controlled labyrinth heat exchanging oil nozzle assembly according to claim 1 wherein said means for undulatingly directing comprises at least one flow director plug which sealingly fits into a corresponding at least one slip-fitting cylindrical bore defined within said block portion and having bore walls and a bore bottom, said bore and said plug are sized relative to each other and assembled in space relationship so as to define an undulating fuel flow directing passage which passage has horizontal segments, vertical segments and bottom segments each created by the combined geometries of said plugs and said bores and an input segment and an output segment said input segment adapted to be attachable to a fuel line and said output segment adapted to be attachable to and in fuel flow communication with said nozzle.

3. The controlled labyrinth heat exchanging oil nozzle assembly according to claim 2 further comprising means for securing and locating said flow director plugs.

4. The controlled labyrinth heat exchanging oil nozzle assembly according to claim 3 wherein said means for securing and locating said flow director plugs comprises a locating member removably attached to said block and positioned to cooperate with notches at a seal end of said plug so as to effectively orient and locate said plug within said bore and wherein said plug further comprises; input/output flat portions which cooperate with said bore wall to define said vertical segments; a tip end which cooperates with said bore bottom to define said bottom segments and cylinder portions which substantially contact said cylinder bore walls.

* * * * *